US006899446B1

(12) United States Patent
King

(10) Patent No.: US 6,899,446 B1
(45) Date of Patent: May 31, 2005

(54) LIGHT FIXTURE PROTECTION GRILL

(76) Inventor: Paul Francis King, 6827 Thames Rd., Woodbury, MN (US) 55125

( * ) Notice: Subject to any disclaimer, the term of this patent is extended or adjusted under 35 U.S.C. 154(b) by 138 days.

(21) Appl. No.: 10/405,753

(22) Filed: Apr. 3, 2003

(51) Int. Cl.[7] ..... F21V 15/02
(52) U.S. Cl. ..... 362/376; 362/344
(58) Field of Search ..... 362/376, 378, 362/375, 344, 400, 310, 377

(56) References Cited

U.S. PATENT DOCUMENTS 4,644,456 A * 2/1987 Lydell ..... 362/376
5,369,559 A * 11/1994 Hedrick et al. ..... 362/376
5,408,399 A * 4/1995 Atkins et al. ..... 362/376
5,695,278 A * 12/1997 Grossman et al. ..... 362/374
5,984,490 A * 11/1999 Leen ..... 362/240

* cited by examiner

*Primary Examiner*—Y. My Quach-Lee
*Assistant Examiner*—Peggy A. Neils
(74) *Attorney, Agent, or Firm*—Thomas B. Tate

(57) ABSTRACT

A grill for protecting light fixtures in a dome-type sports arena from being hit by balls. The grill comprises cross members mountable on a light fixture, upright members connected to the cross members, and a plurality of bows which surround the light on both ends, front, top, and bottom.

1 Claim, 1 Drawing Sheet

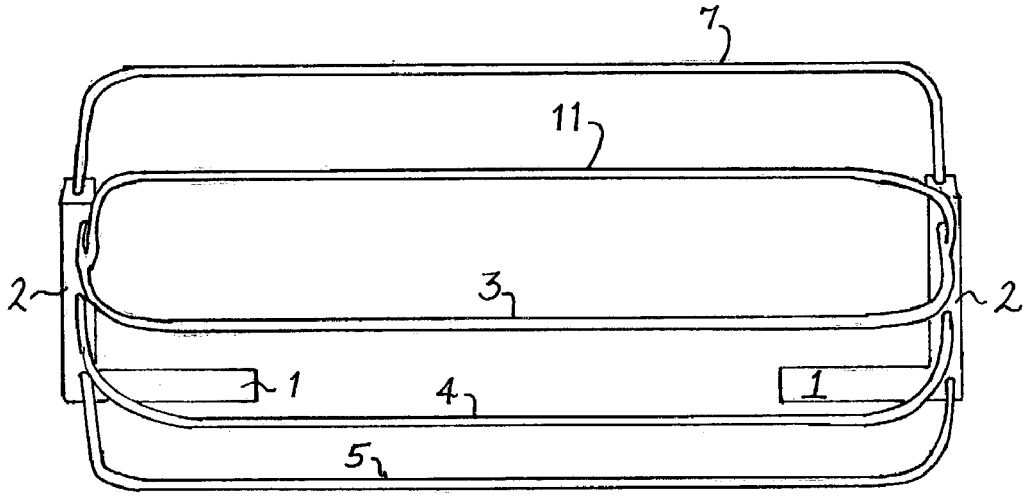
7
11
2
3
2
1
4
1
5

LIGHT FIXTURE PROTECTION GRILL

BACKGROUND OF THE INVENTION

The field of the invention is light fixture protection grills.

Inflatable dome-type arenas are used for indoor practice of such sports as soccer, baseball, football, and golf when the weather is unsuitable for practicing outdoors. These arenas typically have lighting fixtures which are mounted at the seam between the floor and the dome, and which have a pole that projects diagonally upward and swivels, with the light or row of lights about ten feet above the floor. The light bulbs in such fixtures get beat up from being hit by balls flying through the air. At present there is no satisfactory way to prevent that from happening.

SUMMARY OF THE INVENTION

The invention solves this problem by providing a grill that can be mounted onto the light fixture and which surrounds the light so that it is protected on both ends, the front, the top, and the bottom.

DESCRIPTION OF THE DRAWING

The FIGURE is a front perspective view.

DETAILED DESCRIPTION OF THE INVENTION

The light fixture protection grill comprises a pair of cross members 1, a pair of upright members 2, a top front bow 3, a middle front bow 4, a bottom front bow 5, a rear top bow 7, and a front top bow 11. The grill can be made in various sizes in order to protect light fixtures of different sizes and having different numbers of bulbs. Most versions of this grill are between six and sixteen feet long.

The cross members 1 are attached to the cross pole on the light fixture holder (resting on top and in front thereof) by means of U-bolts, preferably two U-bolts through each cross member 1.

The upright members 2 are attached to and project upwardly perpendicular from the cross members 1. Each upright 2 is welded to its corresponding cross member 1.

The bows 3, 4, 5, 7, and 11 are formed of hollow stainless steel tubing, preferably seven-eighths of an inch in diameter, and are bent near each end so that each bow's center section is much longer than its two end sections.

The top front bow 3, middle front bow 4, and bottom front bow 5 are each welded at one end to the front surface of one of the uprights 2 and are each welded at the opposite end to the front surface of the other upright 2, and are positioned in generally parallel spaced relationship to each other.

The rear top bow 7 and front top bow 11 are each welded at each end to the end sections of top front bow 3, bow 7 at the ends thereof and bow 11 approximately in the middle of the end sections of bow 3, forming joints at the points of welding. Rear top bow 7 is positioned higher than front top bow 11. Front top bow 11 is angled forwardly to an angle of about seventy-five degrees.

The grill surrounds the light on both ends, the front, the top, and the bottom, with bows 3, 4, and 5 projecting out about three inches in front of the light. The spacing and positioning of bows 3, 4, 5, 7, and 11 is such that large balls such as soccer balls cannot fit in between the bows. The bows absorb the impact of the balls without bending, and thus protect the light.

Some optional features may be added to the preferred embodiment described above. A fine mesh net may be attached to the grill on the front, sides, top, and bottom, being tied onto the bows by bungee cords. This will help prevent small balls such as golf balls from passing between the bows. If the net does not extend far enough down, a brace across the bottom of the grill below the cross members 1 and a corresponding additional bow (below and parallel to bottom front bow 5) could be included. In larger versions of the grill, it may be desirable to use stiffeners between the bows (welded on to keep the bows from flexing apart or together). This feature would not be needed on shorter versions of the grill.

The examples given herein are cited as illustrations of the best mode for carrying out the invention and not by way of limitation. It is intended that the scope of the invention include the full range of equivalents and any modifications which do not depart from the spirit of the invention.

I claim:

1. A grill adapted to protect a light fixture in a sports arena from being hit by balls, said grill comprising:

a pair of cross members mountable on said light fixture;

an upright member attached to and projecting upwardly from each of said cross members;

a plurality of bows, each bow comprising a length of tubing which has a bend near each end such that each bow has a center section which is longer than said bow's two end sections, said bows being arranged as follows:

a top front bow, a middle front bow, and a bottom front bow, each of which is attached at one end to the front surface of one of said upright members and at the opposite end to the front surface of the other of said upright members, said top front bow, said middle front bow, and said bottom front bow being disposed in generally parallel spaced relationship;

a rear top bow attached at one end to one end section of said top front bow and at the opposite end to the opposite end section of said top front bow;

a front top bow attached at each end to an end section of said top front bow, said front top bow being angled forwardly.

* * * * *